US006668480B1

(12) United States Patent
Riley

(10) Patent No.: US 6,668,480 B1
(45) Date of Patent: Dec. 30, 2003

(54) SYSTEM FOR CLEANING GUN BARRELS

(75) Inventor: Bruce Riley, Millville, NJ (US)

(73) Assignee: Ultra Clean Technologies, Corp., Bridgeton, NJ (US)

( * ) Notice: Subject to any disclaimer, the term of this patent is extended or adjusted under 35 U.S.C. 154(b) by 0 days.

(21) Appl. No.: 10/267,258

(22) Filed: Oct. 9, 2002

(51) Int. Cl.[7] ..... F41A 13/04
(52) U.S. Cl. ..... 42/95; 15/3.5
(58) Field of Search ..... 42/90, 95

(56) References Cited

U.S. PATENT DOCUMENTS 3,398,417 A * 8/1968 Erwin ..... 15/104.19
3,536,160 A * 10/1970 Brewer ..... 184/109
4,328,632 A * 5/1982 Beers ..... 42/95
4,599,173 A * 7/1986 Berger ..... 210/451
4,726,137 A * 2/1988 Zurek et al. ..... 42/95
4,783,925 A * 11/1988 Pollock, Jr. ..... 42/90
4,843,750 A * 7/1989 Blase ..... 42/95
4,974,277 A 12/1990 Casella
4,998,368 A * 3/1991 Blase ..... 42/95
5,329,660 A 7/1994 Fowler
5,341,744 A * 8/1994 Shi ..... 102/442
5,555,585 A 9/1996 Fowler
5,777,258 A 7/1998 Soon
5,815,975 A * 10/1998 Rambo et al. ..... 42/95
5,963,843 A * 10/1999 Sit et al. ..... 725/146

* cited by examiner

*Primary Examiner*—Michael J. Carone
*Assistant Examiner*—Troy Chambers
(74) *Attorney, Agent, or Firm*—Norman E. Lehrer

(57) ABSTRACT

A system for cleaning the barrel of a gun which includes a compressible foam projectile, a source of compressed gas, and a flexible connector, such as a hose, for connecting the projectile with the cylinder is disclosed. The projectile resides within a nozzle which is secured to the hose. The cylinder is secured to one end of the hose. In order to clean the gun, the nozzle with the projectile inserted therein is placed within the barrel of the gun. The nozzle forms an airtight seal with the barrel. The compressed gas is released from the cylinder into the nozzle. The gas propels the projectile out of the nozzle and through the barrel. As the projectile travels through the barrel, it wipes the barrel clean.

10 Claims, 3 Drawing Sheets

SYSTEM FOR CLEANING GUN BARRELS

BACKGROUND OF THE INVENTION

The present invention is directed toward a system for cleaning gun barrels and more particularly, toward a system which allows the barrel of a gun to be cleaned in an efficient manner.

Often deposits of dirt, moisture, metal, burnt powder, and the like collect on the interior of a shell chamber and barrel of a firearm. Such deposits must be removed in order to assure the proper maintenance and functioning of the firearm, thereby avoiding potentially dangerous conditions.

One way to clean the barrel is by inserting an elongated metal rod with a brush or a similar type of cleaning device attached thereto into the barrel. This method, however, can be cumbersome and inconvenient to use. Furthermore, it may not be very efficient.

Another method is described in U.S. Pat. No. 4,998,368 to Blase. This patent discloses a disposable firearm cleaning device which includes a compressed gas cartridge which is placed within the chamber of a gun. A spring-loaded valve which may be actuated by the firing pin of the firearm releases the compressed gas which flows between the cartridge and chamber walls and out the bore of the firearm propelling a cleaning material through the barrel, thereby cleaning the chamber and bore. The problem with the device, however, is that using the firing pin of the gun to propel the cleaning device through the gun causes unnecessary wear on the gun.

Yet another method for cleaning the barrel of a gun is disclosed in U.S. Pat. No. 4,328,632 to Beers. This patent discloses a cleaning device which includes a casing having several cleaning layers such as an abrasive, a solvent, and a lubricant. A compressed gas cartridge disposed in the casing which is activated by the firing pin of the gun propels the cleaning layers through the barrel. Similar to the patent discussed above, this patent also relies on the mechanics of the gun in order to clean the barrel, thereby causing additional wear on the gun.

Therefore, a need exists for a system which functions independently of the gun for cleaning the barrel of the gun in a simple and efficient manner.

SUMMARY OF THE INVENTION

The present invention is designed to overcome the deficiencies of the prior art discussed above. It is an object of the present invention to provide an efficient method for cleaning the barrel of a gun.

It is a further object of the present invention to provide a system for cleaning the barrel of a gun which operates independently of the gun.

In accordance with the illustrative embodiments demonstrating features and advantages of the present invention, there is provided a system for cleaning gun barrels which includes a compressible foam projectile, a cylinder of compressed gas, and means for connecting the projectile with the cylinder. The projectile resides within a nozzle which is secured to the connecting means. The cylinder is also secured to the connecting means. In order to clean the gun, the nozzle with the projectile inserted therein is placed within the barrel of the gun. The nozzle forms an airtight seal with the barrel. The compressed gas is released from the cylinder into the nozzle. The gas propels the projectile out of the nozzle and through the barrel. As the projectile travels through the barrel, it wipes the barrel clean.

Other objects, features, and advantages of the invention will be readily apparent from the following detailed description of preferred embodiments thereof taken in conjunction with the drawings.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
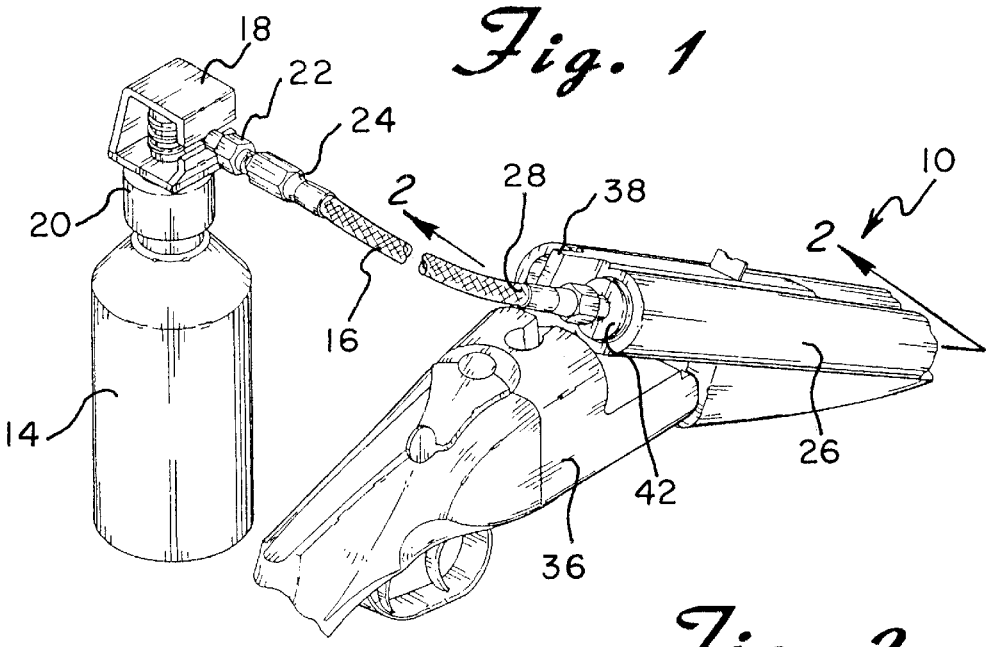
FIG. 1 is a front perspective view of the cleaning system of the present invention being used to clean the barrel of a gun.

Referring now to the drawings in detail wherein like reference numerals have been used throughout the various figures to designate like elements, there is shown in FIG. 1 a cleaning system constructed in accordance with the principles of the present invention and designated generally as 10.

Figure 3:
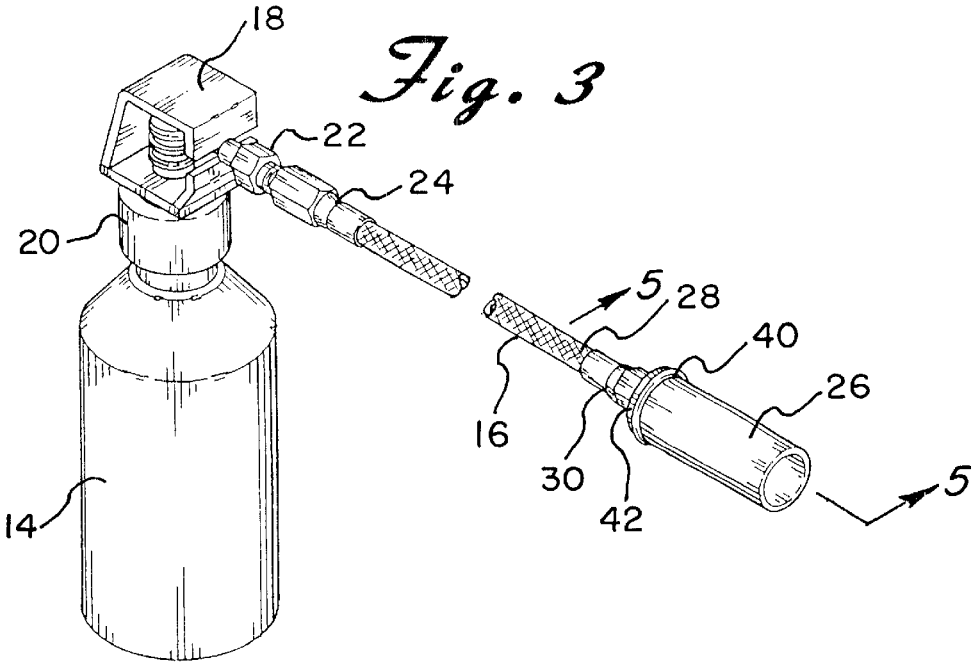
FIG. 3 is a front perspective view of the cleaning system of the present invention.

The present invention essentially includes a compressible projectile 12 which may be made from polyurethane foam, felt, or the like, a source of compressed gas 14, and means 16 for connecting the projectile 12 with the gas 14. The projectile 12 may be generally cylindrical. The gas may be carbon dioxide, nitrogen, compressed air, other inert gases, or the like. The compressed gas may be contained in a bulb, cylinder, canister, or the like. A valve 18 is attached to an opening located at the top 20 of the cylinder 14. When pressure is applied to the valve 18, the valve 18 opens and releases the gas. (See FIG. 3.) The connecting means 16 is preferably a steel miesh reinforced flexible hose or the like.

Figure 4:
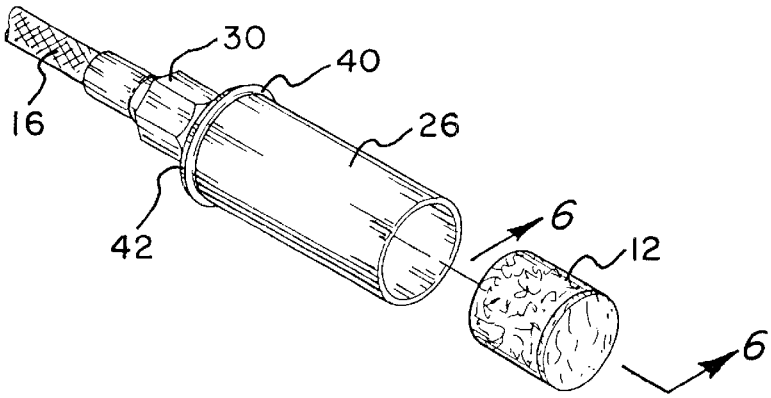
FIG. 4 is a front perspective view of the nozzle of the present invention.
Figure 6:
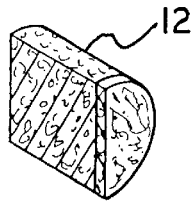
FIG. 6 is a cross-sectional view taken through the line 6—6 of FIG. 4.
Figure 7:
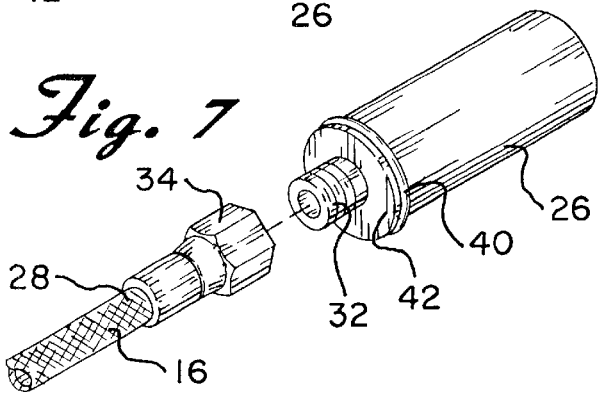
FIG. 7 is a partial exploded view of the nozzle and hose of the present invention.
Figure 8:
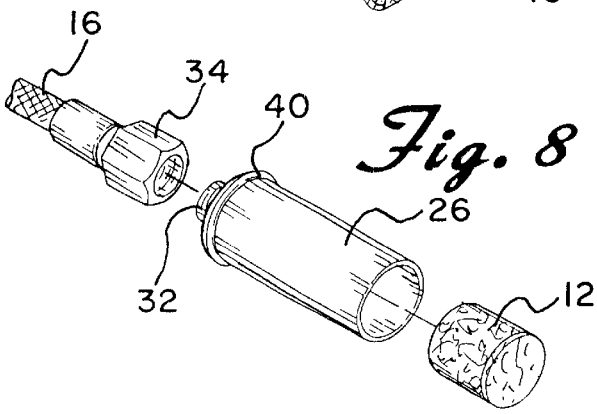
FIG. 8 is a partial exploded view of the hose, nozzle, and projectile of the present invention.

A connecting member 22 is secured to the cylinder 14 and is used to attach the cylinder 14 to a first end 24 of the hose 16. A nozzle 26 is secured to a second end 28 of the hose 16 via fastening means 30. (See FIG. 3.) The fastening means 30 includes a screw threaded male end 32 of the nozzle 26 which fits with corresponding screw threads of the female connector 34 of the hose 16. (See FIGS. 7 and 8.) While screw threads have been shown and described, it should be realized that this is by way of example only and that any type of fastening means known in the art may be used. For example, quick release fasteners may be used. The projectile 12 fits snugly within the nozzle 26. (See FIG. 4.)

Figure 2:
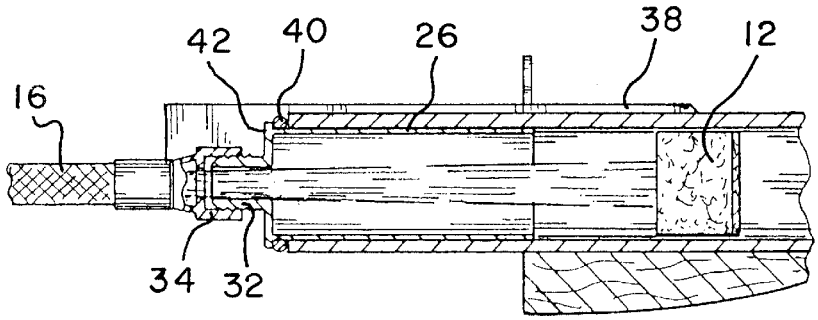
FIG. 2 is a cross-sectional view taken through the line 2—2 of FIG. 1.
Figure 5:
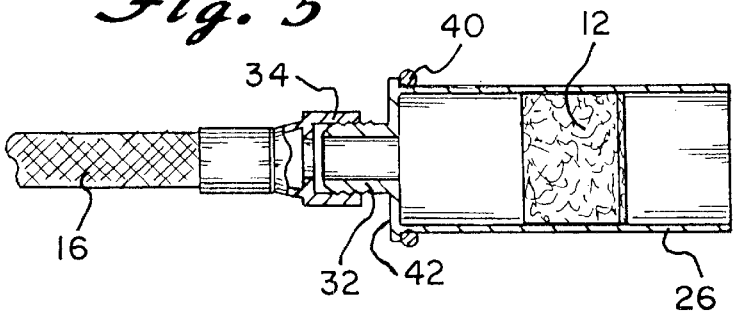
FIG. 5 is a cross-sectional view taken through the line 5—5 of FIG. 3.
Figure 9:
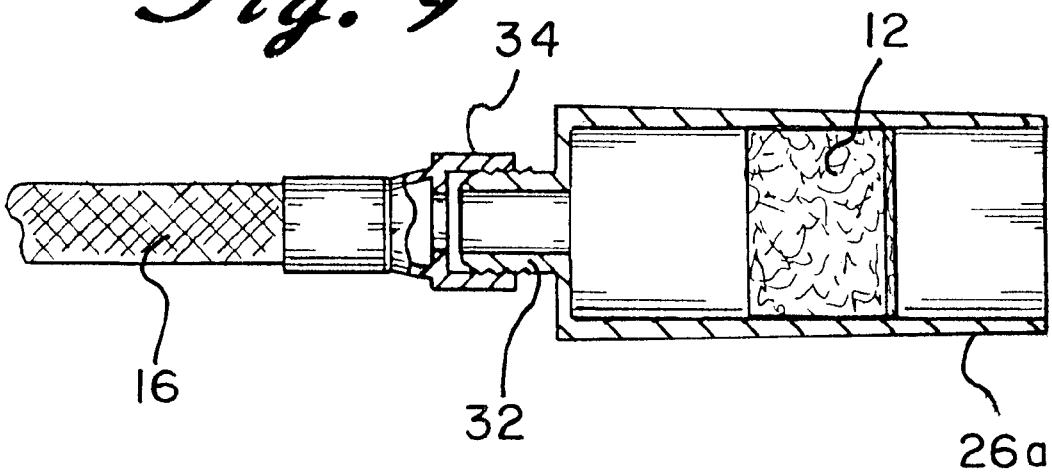
FIG. 9 is a view similar to FIG. 5 showing an alternative embodiment of the nozzle of the present invention.

In order to clean a gun 36, the nozzle 26 with the projectile 12 inserted therein is placed within the barrel 38 of the gun 36. (See FIG. 2.) An airtight seal is formed between the nozzle 26 and the barrel 38 via O-ring 40 which is located on the nozzle 26. A raised portion 42, such as a shoulder or flange is located on the nozzle 26 generally behind the O-ring 40 and keeps the O-ring 40 in place. (See FIG. 5.) Alternatively, the outer surface of the nozzle may be tapered so that it will form an airtight seal with the barrel 38, without the use of an O-ring. Such a modification is shown, for example, as nozzle 26*a* in FIG. 9. In the non-tapered version, the outer diameter of the nozzle 26 is slightly smaller than the inner diameter of the barrel 38 of the gun 36 so that the nozzle 26 fits snugly within the barrel 38. (See FIG. 2.) It should be realized, however, that the size of the nozzle may vary in order to provide a proper fit within the barrel. Likewise, the size of the projectile may vary in order to fit various types of guns.

As the compressed gas is released from the cylinder 14, it travels through the hose 16, and into the nozzle 26. The gas propels the projectile 12 out of the nozzle 26 and through the barrel 38. As the projectile 12 travels through the barrel 38, it expands and wipes the barrel 38 clean. Powder nitrate solvents may be used along with different types of projectiles to aid in cleaning the barrel.

The present invention may be embodied in other specific forms without departing from the spirit or essential attributes thereof and accordingly, reference should be made to the appended claims rather than to the foregoing specification as indicating the scope of the invention.

I claim:

1. A system for cleaning the barrel of a gun comprising:

a source of compressed gas located outside of the barrel;

a generally cylindrical projectile adapted to clean the barrel of a gun;

a nozzle within which said projectile fits; and a flexible hose for connecting said compressed gas with said nozzle wherein said nozzle is adapted to fit snugly within the barrel of a gun and said projectile is propelled from said nozzle and through said barrel when said compressed gas is released.

2. The system for cleaning the barrel of a gun of claim 1 further including means for forming an airtight seal between said nozzle and the barrel.

3. The system for cleaning the barrel of a gun of claim 2 wherein said means for forming an airtight seal includes a flange and an O-ring located on said nozzle.

4. The system for cleaning the barrel of a gun of claim 2 wherein said means for forming an airtight seal includes the outer surface of said nozzle being tapered.

5. The system for cleaning the barrel of a gun of claim 1 wherein said projectile is made from compressible foam.

6. The system for cleaning the barrel of a gun of claim 1 wherein said source of compressed gas is one from the group consisting of carbon dioxide, nitrogen, compressed air, and other inert gases.

7. A method for cleaning the barrel of a gun comprising the steps of:

providing a source of compressed gas located outside of the barrel, a generally cylindrical projectile adapted to clean the barrel of a gun, a nozzle within which said projectile fits, and a flexible hose for connecting said compressed gas with said nozzle;

fitting said nozzle within the barrel of a gun; and propelling said projectile from said nozzle when said compressed gas is released and through said barrel, wherein said projectile cleans the barrel of the gun as it passes therethrough.

8. The method for cleaning the barrel of a gun of claim 7 further including the step of forming an airtight seal between said nozzle and the barrel.

9. The method for cleaning the barrel of a gun of claim 8 wherein said step of forming an airtight seal includes the use of a flange and an O-ring located on said nozzle.

10. The method for cleaning the barrel of a gun of claim 8 wherein said step of forming an airtight seal includes the outer surface of said nozzle being tapered.

* * * * *